US005697764A

United States Patent [19]

Oda et al.

[11] Patent Number: 5,697,764

[45] Date of Patent: Dec. 16, 1997

[54] DISPLACEMENT CONTROL SYSTEM FOR VARIABLE DISPLACEMENT HYDRAULIC PUMP

[75] Inventors: Yosuke Oda; Kiyoshi Shirai, both of Kanagawa, Japan

[73] Assignee: Kabushiki Kaisha Komatsu Seisakusho, Tokyo, Japan

[21] Appl. No.: 416,757

[22] PCT Filed: Oct. 29, 1993

[86] PCT No.: PCT/JP93/01577

§ 371 Date: Apr. 13, 1995

§ 102(e) Date: Apr. 13, 1995

[87] PCT Pub. No.: WO94/10447

PCT Pub. Date: May 11, 1994

[30] Foreign Application Priority Data

Oct. 29, 1992 [JP] Japan ..... 4-291195

[51] Int. Cl.[6] ..... F04B 49/00

[52] U.S. Cl. ..... 417/212; 417/218; 60/452

[58] Field of Search ..... 417/212, 218; 60/452

[56] References Cited

U.S. PATENT DOCUMENTS

| | | | |
|---|---|---|---|
| 4,553,904 | 11/1985 | Ruseff et al. | 60/452 |
| 4,821,514 | 4/1989 | Schmidt et al. | 60/452 |
| 5,201,803 | 4/1993 | Goto et al. | 60/452 |
| 5,203,678 | 4/1993 | Sugiyama et al. | 417/218 |

FOREIGN PATENT DOCUMENTS

| | | |
|---|---|---|
| 0294776 | 12/1988 | European Pat. Off. . |
| 2952083 | 6/1981 | Germany . |
| 3143074 | 5/1983 | Germany . |

*Primary Examiner*—Timothy Thorpe
*Assistant Examiner*—Peter G. Korytnyk
*Attorney, Agent, or Firm*—Ronald P. Kananen

[57] ABSTRACT

There is provided a displacement control system for a variable displacement hydraulic pump which has a displacement control piston assembly (6) having a large diameter chamber (7) for operating a displacement control member (5) of the variable displacement hydraulic pump selectively in a direction of smaller displacement and in a direction of larger displacement, first control valve (8) and second control valve (9) for selectively communicating the large diameter chamber of the displacement control piston assembly with a pump discharge line and a tank, the first control valve being placed at a supply position by the pump discharge pressure, and at a drain position by a spring associated with the displacement control piston assembly via a feedback lever, and the second control valve being placed at a first position by the pump discharge pressure for communicating the pump port and the large diameter chamber and at a second position by a load pressure for communicating the pump port and the large diameter chamber and at a second position by a load pressure for communicating the large diameter chamber to the first control valve, the flow path area is varied at the intermediate position of a fluid passage from the large diameter chamber to the pump discharge passage or to a tank. With the construction set forth above, supply speed and drain speed of the pump discharge pressure to and from the large diameter chamber of the displacement control piston assembly is varied by variation of cross-sectional flow area at the intermediate position of the fluid passage. By this, response characteristics in displacement control of the variable displacement hydraulic valve can be adjusted to improve operability of a work implement.

8 Claims, 4 Drawing Sheets

DISPLACEMENT CONTROL SYSTEM FOR VARIABLE DISPLACEMENT HYDRAULIC PUMP

This application is a 371 Continuation of PCT/JP93/01577 Oct. 29, 1993.

FIELD OF THE INVENTION

The present invention relates to a displacement control system for a variable displacement hydraulic pump to be employed in a hydraulic circuit of an actuator for a work implement of a constructional machine and so forth.

DESCRIPTION OF THE BACKGROUND ART

As a system for controlling a displacement (discharge amount per one cycle of revolution) of a variable displacement hydraulic pump (hereinafter referred to as variable hydraulic pump), there has been known a system for adjusting a drive torque (displacement X pump discharge pressure) of the variable hydraulic pump by controlling a displacement depending upon a pump discharge pressure.

On the other hand, as a hydraulic circuit for an actuator for a work implement of a constructional machine, such as a power shovel, there has been known a pressure compensation type hydraulic circuit, in which a discharged pressurized fluid of one variable hydraulic pump is supplied to a plurality of actuators through a plurality of operating valves, a pressure compensation valve is disposed at the midway of a pressurized fluid supply passage for each actuator, and respective pressure compensation valves are set a load pressure corresponding to the highest load pressure to simultaneously distribute the discharged pressurized fluid of one variable hydraulic pump to a plurality of actuators having mutually distinct load pressures.

In this pressure compensation type hydraulic circuit, by controlling the displacement of the variable hydraulic pump depending upon the discharge pressure, the torque required for driving a variable hydraulic pump is controlled to be constant by adjusting the displacement smaller at higher discharge pressure and by adjusting the displacement greater at low discharge pressure. When the pressure difference is large, the displacement is adjusted to be smaller and when the pressure difference is small, the displacement is adjusted to be larger to reduce energy loss.

In case of the system for controlling the displacement depending upon the pump discharge pressure and the load pressure as set forth above, it is desired to make it possible to adjust response characteristics in control of the variable hydraulic pump in order to improve operability of the work implement.

The present invention is worked out in view of the above-mentioned point. It is an object of the present invention to provide a displacement control system for a variable displacement hydraulic pump which can improve operability of a work implement by adjusting response characteristics in control of the variable displacement hydraulic pump.

DISCLOSURE OF THE INVENTION

In order to accomplish above-mentioned and other objects, as one aspect of the present invention, there is provided a displacement control system for a variable displacement hydraulic pump comprises a displacement control piston assembly having a large diameter chamber for operating a displacement control member of the variable displacement hydraulic pump selectively in a direction of smaller displacement and in a direction of larger displacement, first control valve and second control valve for selectively communicating the large diameter chamber of the displacement control piston assembly with a pump discharge line and a tank, the first control valve being placed at a supply position by the pump discharge pressure, and at a drain position by a spring associated with the displacement control piston assembly via a feedback lever, and the second control valve being placed at a first position by the pump discharge pressure for communicating the pump port and the large diameter chamber and at a second position by a load pressure for communicating the large diameter chamber to the first control valve, the flow path area is varied at the intermediate position of a fluid passage from the large diameter chamber to the pump discharge passage or to a tank.

With the construction set forth above, by variation of the cross-sectional flow area at the intermediate position of the fluid passage, the supply and drain speed of the pump discharge pressure to the large diameter chamber of the displacement control piston assembly is varied. By this, response characteristics of the displacement control of the variable displacement hydraulic pump can be adjusted.

It should be noted that as the construction for varying the cross-sectional flow area at the intermediate position of the fluid passage is preferably the flow restriction provided in the communicating fluid passage of the large diameter chamber and the second control valve.

Preferably, the open area is large at the supply position of the first control valve and the open area is small at the drain position.

With the construction set forth above, the supply speed and drain speed of the pump discharge pressure to and from the large diameter chamber of the displacement control piston assembly can be differentiated.

On the other hand, the open area at the first position of the second control valve is large and the open area at the second position is small.

Also, the flow restriction may be provided in the first control valve.

Furthermore, the flow restriction is provided in the communicating fluid passage between the first control valve end the second control valve.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

BEST MODE FOR IMPLEMENTING THE INVENTION

Figure 1:
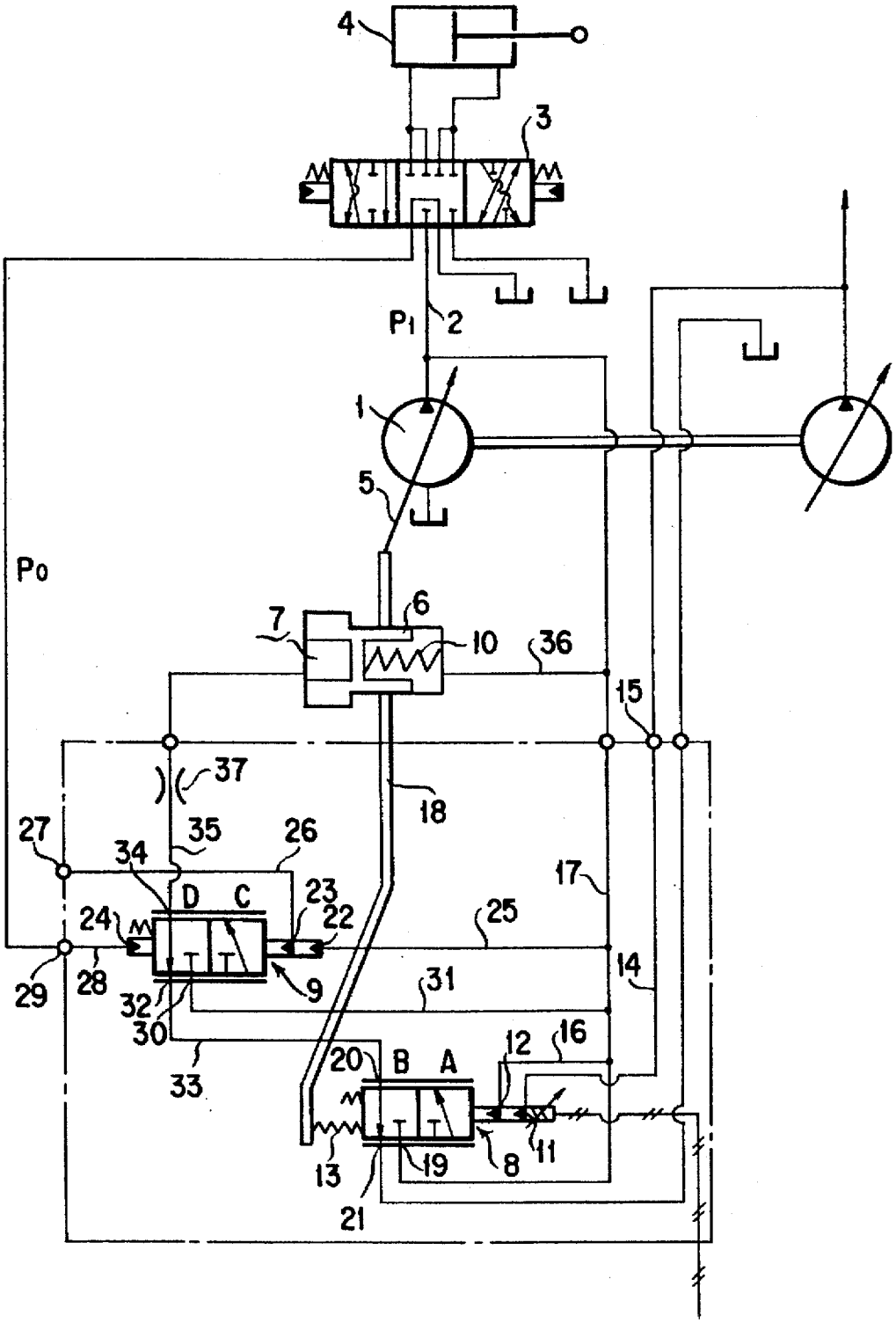
FIG. 1 is an explanatory illustration showing a construction of the first embodiment of a displacement control system of a variable displacement hydraulic pump according to the present invention.

FIG. 1 shows the first embodiment of the present invention.

In the shown embodiment, a discharge line 2 of a variable displacement hydraulic pump 1 (hereinafter referred to as a variable hydraulic pump 1) is connected to an actuator 4 via an operating valve 3. A displacement control piston assembly 6 for actuating a displacement control member, such as a swash plate 5 of the variable hydraulic pump in a larger displacement direction and a smaller displacement direction, is provided. Supply of a pump discharge pressure to a large diameter chamber 7 of the displacement control piston assembly 6 is controlled by a first control valve 8 and a second control valve 9. In the alternative, the pump discharge pressure is supplied to a smaller diameter chamber 10.

The first control valve 8 is depressed toward a supply position A by the pressure within first and second pressure receiving portions 11 and 12, and toward a drain position B by means of a spring 13. The first pressure receiving portion 11 is communicated with an external hydraulic pressure signal input port 15 via a first fluid passage. The second pressure receiving portion 12 is communicated with a pump pressure induction passage 17 via a second fluid passage 16. The spring 13 is placed in contact with a feedback lever 18. Then, the first control valve 8 thus constructed supplied pump pressure from an inlet port 19 to an outlet port 20 and selectively establishes and blocks communication between the outlet port 20 and a tank port 21.

The second control valve 9 is depressed to a first position C by pressures of first and second pressure receiving portions 22 and to a second position D by a pressure of a third pressure receiving portion 24. The first pressure receiving portion 22 is communicated with the pump pressure induction passage 17 via a third fluid passage 25. The second pressure receiving portion 23 is communicated with a port 27 via a fourth fluid passage 26. The third pressure receiving portion 24 is communicated with a load pressure port 29 via a fifth fluid passage 28. An inlet port 30 is communicated with the pump pressure introduction passage 17 via a sixth fluid passage 31. The first port 32 is communicated with the outlet port 20 of the first control valve 8 via a seventh fluid passage 33. The second port 34 is communicated with a large diameter chamber 7 via a eighth fluid passage 35. Also, a smaller diameter chamber 10 is communicated with a pump pressure introduction passage 17 via a ninth fluid passage 36.

Next, discussion will be given for control of a discharge amount (displacement) per one cycle of revolution of the variable hydraulic pump 1 by tilting the swash plate 5.

When the discharge pressure P1 of the variable hydraulic pump 1 becomes high, the first control valve 8 is placed at a supply position A to supply the pump discharge pressure to the large diameter chamber 7 via a second control valve 9. Then, by a pressure difference to be induced by difference of pressure receiving areas of the large diameter chamber 6 and the small diameter chamber 6, a displacement control piston assembly 6 is depressed toward right to pivot the swash plate 5 in a direction of smaller tilting angle (direction for smaller displacement).

By this, the feedback lever 18 is shifted toward right to increase a set load on a spring 13. Therefore, the first control valve 8 is depressed to the drain position B so that the pressurized fluid in the large diameter chamber 7 flows to the train to pivot the swash plate 5 in a direction of larger tilting angle (direction for larger displacement).

Then, the foregoing operation balances at an appropriate position. By this, the discharge amount of the variable hydraulic pump 1 becomes a value corresponding to the pump discharge pressure P1.

Namely, by the first control valve 8 and the feedback lever 18, the displacement of the pump can be varied depending upon the discharge pressure of the variable hydraulic pump. Therefore, the torque necessary for driving the variable hydraulic pump can be constant at all times.

It should be noted that by adjusting the pressure to be supplied to the first pressure receiving portion 11 from the external hydraulic pressure signal input port 15, the magnitude of the constant drive torque can be varied.

On the other hand, the second control valve is placed at the second position D if the pressure difference in the operating valve is small since the demanded flow rate of the operating valve is greater than the discharge amount of the pump when the load pressure P0 is equal to the pump discharge pressure, when a pressure difference between a set load pressure P0 and the pump discharge pressure is small, and namely, when the open area of the operating valve is large. Therefore, the pressurized fluid of the larger diameter tank flows to the tank to pivot the swash plate 5 in the direction of larger tilting angle (direction for greater displacement) to increase the pump discharge amount (displacement).

Namely, the second control valve 9 controls the discharge amount (displacement) of the variable hydraulic pump per one revolution cycle so that the pressure difference between the pump discharge pressure P1 and the load pressure P0 is constant, namely the pump discharge amount becomes consistent with a demanded flow rate of operating valve.

With such displacement control system, the response characteristics of in displacement control in the variable hydraulic pump can be determined by the supply and drain speed of the pump discharge pressure to the large diameter chamber 7 of the displacement control piston assembly 6.

Therefore, in the shown embodiment, an orifice 37 is provided in the eighth fluid passage 35. By this orifice 37, the response characteristics in the displacement control is adjusted. Namely, since the flow rate at the mid portion of the fluid passage 35 is varied, the supply and drain speed of the pump discharge pressure to the large diameter chamber 7 of the piston 6 is varied to permit adjustment of the response characteristics in the displacement control of the variable hydraulic pump 1 to improve operability of the work implement.

Here, when the response characteristics of the displacement control is adjusted as set forth above, the response characteristics in displacement control of the variable hydraulic pump in the case from small displacement to large displacement and in the case from large displacement to small displacement, becomes equal to each other.

Therefore, when the response characteristics is retarded from the small displacement to the large displacement for improving operability of the work implement, the response characteristics from large displacement to small displacement can also be retarded. Therefore, when the load on the work implement is abruptly increased, it is caused a delay into small displacement. Thus, engine load can be significantly increased to cause stall of the engine or so forth. Also, upon starting-up of the engine, it is delayed to establishing the small displacement to cause larger resistance against engine revolution to degrade start-up characteristics of the engine.

Therefore, the embodiment discussed hereinafter is designed for preventing engine stalling upon abrupt increasing of the load and for improving the start-up characteristics of the engine.

In the second embodiment, the orifice 37 in FIG. 1 is not provided. Instead, the second embodiment provides smaller open area between the inlet port 19 and the outlet port 20 of the first control valve 8 than the open area between the outlet port 20 and the tank port 21.

By this, to the large diameter chamber 7 of the displacement control piston assembly 6, the pump discharge pressure can be supplied smoothly to improve response characteristics in displacement control from large displacement to small displacement, while response characteristics in displacement control from small displacement to large displacement can be held low since the pressurized fluid in the large diameter chamber 7 of the displacement control piston assembly 6 flows to the tank at small flow rate.

Figure 2:
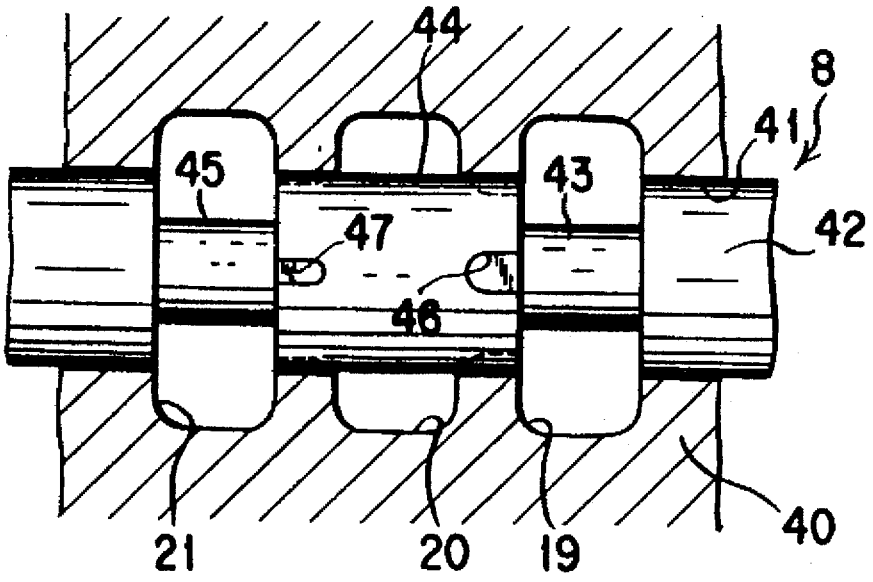
FIG. 2 is a section of a first control valve in the second embodiment of the invention.

As a concrete example of the first control valve 8, as shown in FIG. 2, a spool 42 is inserted in a spool bore 41 of a valve body 40 and the inlet port 19, the outlet port 20, the tank port 21 are formed to open to the spool bore 41. A first smaller diameter portion 43, an intermediate larger diameter portion 44 and a smaller diameter portion 45 are formed on the spool 42. A first cut-out groove 46 for communicating the inlet port 19 and the outlet port 20 is formed on the intermediate larger diameter portion. Also, a second cut-out groove 47 is formed for communicating the outlet port 20 and the tank port 21. The cross-sectional area of the first cut-out groove 46 is greater than that of the second cut-out groove 47.

By this, the open area between the inlet port 19 and the outlet port 20 when the spool 42 is shifted toward left, becomes greater than that open area between the outlet port 20 and the tank port 21 when the spool 42 is shifted toward right in the same distance.

It should be noted that it is possible to provide larger cross-sectional open area for the open area between the inlet port 30 and the second port 34 of the second control valve and to provide smaller cross-sectional area between the second port 34 and the first port 32. In this case, the concrete construction of the second control valve 9 may be similar to that of FIG. 2.

Figure 3:
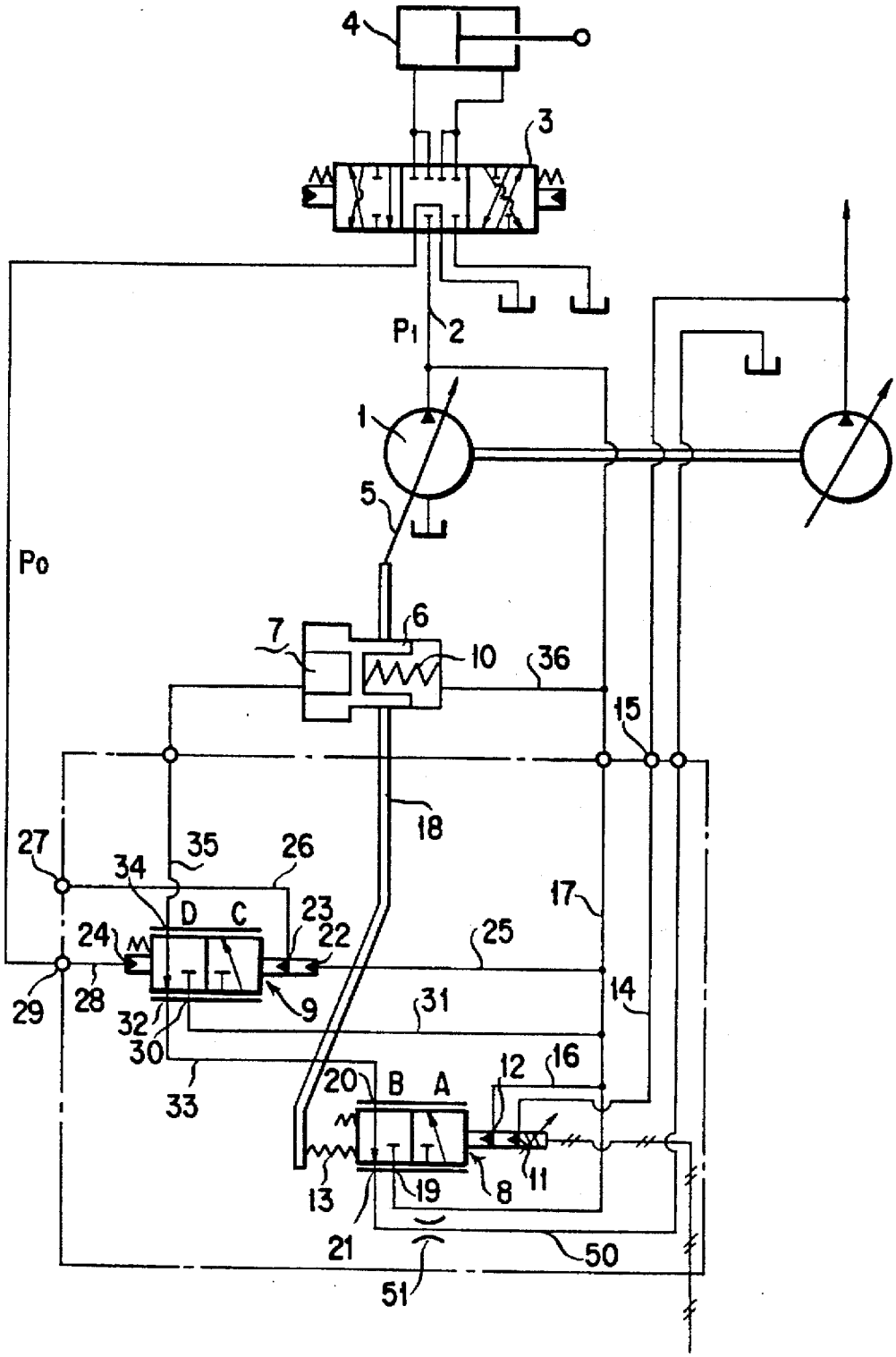
FIG. 3 is an explanatory illustration showing the construction of the third embodiment of the invention.

FIG. 3 shows the third embodiment, in which an orifice 51 is provided in a drain passage 50 communicated with the tank port 21 of the first control valve 8.

By this, the pressurized fluid in the large diameter chamber 7 of the displacement control piston assembly 6 flows gradually to the tank through the orifice 51. Therefore, the response characteristics in displacement control from small displacement to large displacement can be lower than the response characteristics in the displacement control from large displacement to small displacement. Accordingly, the operability of the work implement can be improved, while the engine stalling upon abrupt increasing of the load can be successfully prevented.

Figure 4:
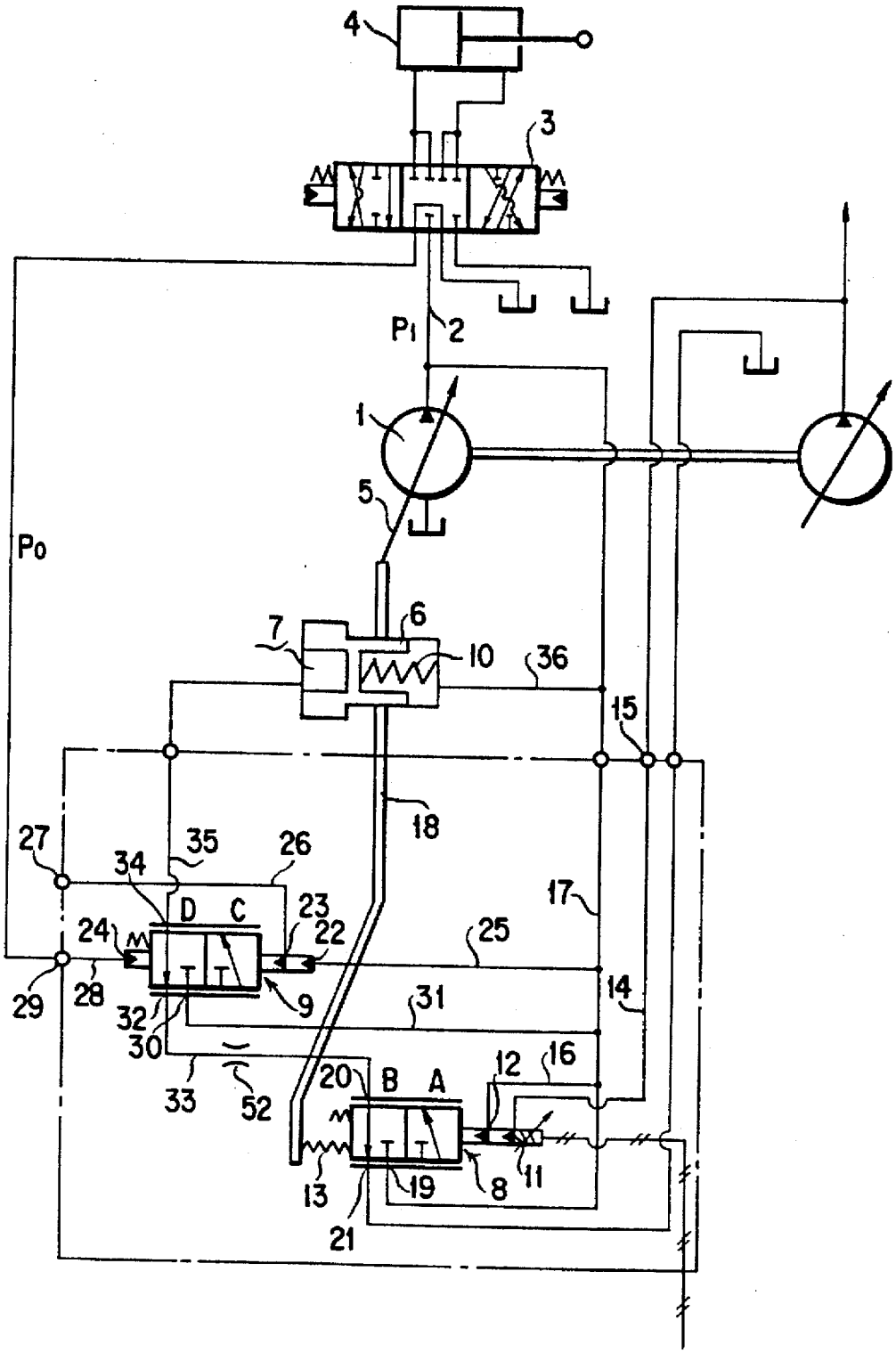
FIG. 4 is an explanatory illustration showing the construction of the fourth embodiment of the invention.

FIG. 4 shows the fourth embodiment. In this embodiment, an orifice 52 is provided in a seventh fluid passage 33 communicating the outlet port 20 of the first control valve and the first port 32 of the second control valve.

By this, the pressurized fluid in the large diameter chamber 7 of the displacement control piston assembly 6 flows gradually to the tank through the orifice 52. Therefore, the response characteristics in displacement control from small displacement to large displacement can be lower than that from large displacement to small displacement.

Thus, since the pressurized fluid discharged from the pump can be smoothly supplied to the large diameter chamber 7 of the displacement control piston assembly 6, the response characteristics from larger displacement to the smaller displacement can be high, while the response characteristics from smaller displacement to larger displacement can be low since the pressurized fluid in the large diameter chamber 7 flows gradually. Therefore, operability of the work implement can be improved, in conjunction therewith to improve engine start-up characteristics.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which within a scope of the accompanying claims and equivalents thereof.

For example, the present invention can be applied to a system which has one of the first control valve 8 and the second control valve 9, while any one of above-mentioned embodiments has both the first and second control valves 8 and 9.

INDUSTRIAL APPLICABILITY

As set forth above, the displacement control system for a variable displacement hydraulic pump according to the present invention is quite useful as a displacement control system for the variable displacement hydraulic pump to be employed in a hydraulic circuit for the actuator for the work implement of the constructional machine and so forth.

We claim:

1. A displacement control system for a variable displacement hydraulic pump, comprising:

a displacement control piston assembly having a large diameter chamber and associated with a displacement control member variable of position for varying displacement of said variable displacement hydraulic pump, for operating said displacement control member of said variable displacement hydraulic pump selectively in a direction of smaller displacement and in a direction of larger displacement by supplying and draining of a pump discharge pressure to and from the large diameter chamber;

a first control valve selectively communicating said large diameter chamber of said displacement control piston assembly with a pump discharge line and a tank and being placed at a supply position by the pump discharge pressure, and at a drain position by a spring associated with said displacement control piston assembly via a feedback lever, a second control valve selectively communicating said large diameter chamber of said displacement control piston assembly with a pump discharge line and tank and being placed at a first position by the pump discharge pressure for communicating the pump discharge line and said large diameter chamber and at a second position by a load pressure chamber for communicating said large diameter chamber to said first control valve, and a flow restriction provided in a fluid passage from said second control valve to a tank.

2. A displacement control system for a variable displacement hydraulic pump as set forth in claim 1, wherein an open area of at least one of said first control valve and said second control valve is large at said first position and is small at said second position.

3. A displacement control system for a variable displacement hydraulic pump as set forth in claim 1, wherein said flow restriction is provided in a drain passage of said first control valve.

4. A displacement control system for a variable displacement hydraulic pump as set forth in claim 1, wherein said flow restriction is provided in a communication passage between said first control valve and said second control valve.

5. A displacement control system for a variable displacement hydraulic pump, comprising:

a displacement control piston assembly having a large diameter chamber, for operating a displacement control member of said variable displacement hydraulic pump in a direction for small displacement and a direction for large displacement depending upon supply and drain of pressurized fluid to and from said large diameter chamber by supplying and draining of a pump discharge pressure to and from the large diameter chamber;

a control valve provided for selectively communicating said large diameter chamber of said displacement control piston assembly to a pump discharge line and a tank, said control valve being placed at a supply position by a pump discharge pressure and to a drain position by a spring associated with said displacement control piston assembly via a feedback lever, and a flow restriction provided in a fluid passage between said control valve and said tank.

6. A displacement control system for a variable displacement hydraulic pump as set forth in claim 5, wherein an open area of said control valve is large at said supply position and is small at said drain position.

7. A displacement control system for a variable displacement hydraulic pump, comprising:

a displacement control piston assembly having a large diameter chamber, for operating a displacement control member of said variable displacement hydraulic pump in a direction for small displacement and a direction for large displacement depending upon supply and drain of pressurized fluid to and from said large diameter chamber by supplying and draining of a pump discharge pressure to and from the large diameter chamber;

a control valve provided for selectively communicating said large diameter chamber of said displacement control piston assembly to a pump discharge line and a tank, said control valve being placed at a first position to establish communication between said pump discharge line and said large diameter chamber by a pump discharge pressure and to a second position to establish communication between said tank and said large diameter chamber by a load pressure, and a flow restriction provided in a fluid passage between said control valve and said tank.

8. A displacement control system for a variable displacement hydraulic pump as set forth in claim 7, wherein an open area of said control valve is large at said supply position and is small at said drain position.

* * * * *